US008851791B1

(12) United States Patent
Putnam

(10) Patent No.: US 8,851,791 B1
(45) Date of Patent: Oct. 7, 2014

(54) MANHOLE COVER VENTING AND PRECIPITATION GUARDING DEVICES

(71) Applicant: David Putnam, Calhoun, LA (US)

(72) Inventor: David Putnam, Calhoun, LA (US)

( * ) Notice: Subject to any disclaimer, the term of this patent is extended or adjusted under 35 U.S.C. 154(b) by 0 days.

(21) Appl. No.: 14/024,221

(22) Filed: Sep. 11, 2013

(51) Int. Cl.
*E02D 29/14* (2006.01)
*E03F 5/08* (2006.01)

(52) U.S. Cl.
CPC .. *E03F 5/08* (2013.01); *E02D 29/14* (2013.01)
USPC ..... 404/25; 52/19

(58) Field of Classification Search
CPC ..... E02D 29/14
USPC ..... 404/25, 26; 52/19, 20
See application file for complete search history.

(56) References Cited

U.S. PATENT DOCUMENTS 2,009,132 A * 7/1935 Gehris ..... 49/465
3,048,958 A 8/1962 Barnes
3,530,882 A 9/1970 Case
3,712,009 A 1/1973 Campagna
3,798,848 A * 3/1974 Campagna ..... 52/20
4,067,659 A * 1/1978 Campagna et al. ..... 404/25
4,512,492 A 4/1985 Graybeal
4,586,941 A 5/1986 Cooley
5,727,351 A * 3/1998 Neathery et al. ..... 52/20
5,846,274 A 12/1998 Smelser
6,126,030 A 10/2000 Kamiyama et al.
6,379,433 B1 4/2002 Scranton, Jr.
6,848,465 B1 2/2005 Ledbetter
2012/0227168 A1 9/2012 Paoluccio et al.

* cited by examiner

*Primary Examiner* — Raymond W Addie
(74) *Attorney, Agent, or Firm* — R. Keith Harrison

(57) ABSTRACT

A manhole cover venting and rain guarding device for a manhole cover having an exterior manhole cover surface and an interior manhole cover surface includes a device housing adapted for attachment to the manhole cover. The device housing includes manhole cover venting and precipitation guarding device includes a device housing adapted for attachment to the manhole cover, the device housing including a head portion having a head portion surface adapted to protrude beyond an entire plane of the exterior manhole cover surface and a device bore extending through the head portion and adapted to communicate with the interior manhole cover surface of the manhole cover.

16 Claims, 7 Drawing Sheets

MANHOLE COVER VENTING AND PRECIPITATION GUARDING DEVICES

FIELD

Illustrative embodiments of the disclosure generally relate to manhole covers. More particularly, illustrative embodiments of the disclosure relate to manhole cover venting and precipitation guarding devices which can be used to vent gases from a sanitary sewer through a manhole cover, limit flow of precipitation into the sewer and prevent overflow of water from the sewer through the manhole cover.

BACKGROUND

The background description provided herein is solely for the purpose of generally presenting the context of the illustrative embodiments of the disclosure. Aspects of the background description are neither expressly nor impliedly admitted as prior art against the claimed subject matter.

Sanitary sewers are subterranean tunnels which transport raw sewage from houses and commercial buildings to a treatment or disposal facility. Sewers may include pipelines which connect houses and buildings to one or more levels of larger underground trunk mains. Manholes are periodically-shaped vertical openings which connect the trunk mains to the ground surface for sewer gas venting and other purposes. Manhole covers are plates which are seated in manhole openings at the ground surface to close the manholes. The manhole covers can be selectively unseated from the manhole openings to provide access to the underlying subterranean sewer structure for cleaning, maintenance or repair.

Manhole cover venting and precipitation guarding devices which vent gases from a sewer through a manhole cover, limit flow of precipitation into the sewer and prevent overflow of floodwater from the sewer through the manhole cover may be desirable for some applications.

SUMMARY

Illustrative embodiments of the disclosure are generally directed to manhole cover veining and precipitation guarding devices for a manhole cover having an exterior manhole cover surface and an interior manhole cover surface. An illustrative embodiment of the manhole cover venting and precipitation guarding device includes a device housing adapted for attachment to the manhole cover, the device housing including a head portion having a head portion surface adapted to protrude beyond an entire plane of the exterior manhole cover surface and a device bore extending through the head portion and adapted to communicate with the interior manhole cover surface of the manhole cover.

BRIEF DESCRIPTION OF THE DRAWINGS

Illustrative embodiments will now be described, by way of example, with reference to the accompanying drawings, in which.

DETAILED DESCRIPTION

Figure 1:
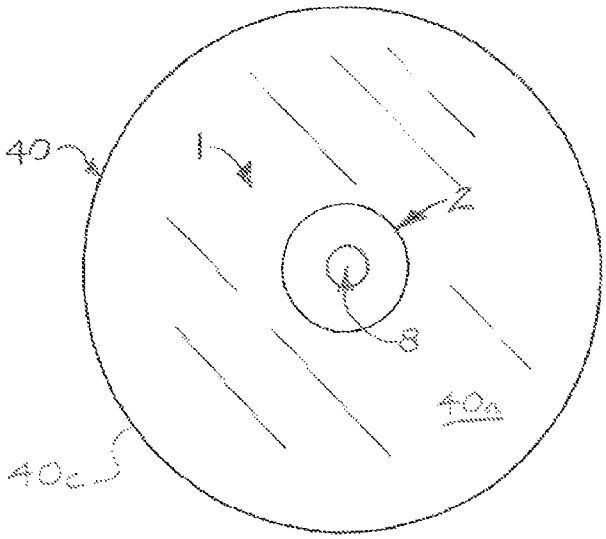
FIG. 1 is a top view of an illustrative embodiment of the manhole cover venting and precipitation guarding devices, mounted in a manhole cover.
Figure 2:
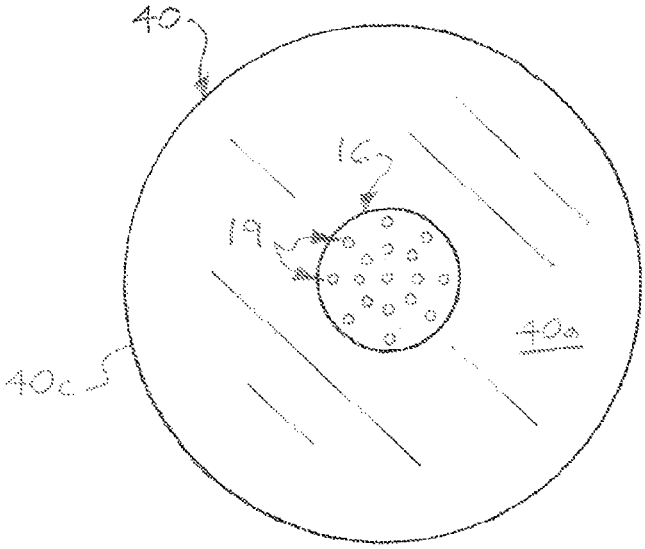
FIG. 2 is a bottom view of an illustrative embodiment of the manhole cover venting and precipitation guarding devices, mounted in a manhole cover.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled a the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Referring initially to FIGS. 1-3 and 8-11 of the drawings, an illustrative embodiment of the manhole cover venting and precipitation guarding devices, hereinafter device, is generally indicated by reference numeral 1. As will be hereinafter further described, the device 1 is adapted to be mounted in a manhole cover 40, which may have a conventional design in some applications. As illustrated in FIGS. 8-11, in exemplary application of the device 1, which will be hereinafter described, the manhole cover 40 is seated in a manhole opening 46 which may lie in the ground or a roadway surface 66 and communicates with a sanitary sewer 50 beneath the ground or roadway surface 66. The device 1 vents or discharges sewer gas 60 (FIG. 10) such as hydrogen sulfide and mercaptan, for example and without limitation, from the sewer 50 to the atmosphere 56, as well as substantially limits the quantity of falling precipitation 62 from the atmosphere 56 or pooled precipitation 62 from the ground or roadway surface 66 which can enter the sewer 50 through the manhole opening 46. The device 1 further prevents overflow water 64 (FIG. 11) from rising from the sewer 50 through the manhole cover 40 and flooding or contaminating the ground or roadway surface 66.

The manhole cover 40 may have a generally planar exterior manhole cover surface 40*a* which lies on or within the ground or roadway surface 66, a generally planar interior manhole cover surface 40*b* which faces the manhole opening 46 and the sewer 50 and a manhole cover edge 40*c* which circumscribes the exterior manhole rover surface 40*a* and the interior manhole cover surface 40*b*. A device opening 41 (FIGS. 4 and 7) may extend through the manhole cover 40 from the exterior manhole cover surface 40*a* to the interior manhole cover surface 40*b*. The manhole cover 40 may have a circumferential manhole cover flange 42. Some conventional manhole covers 40 may have at least one manhole cover opening 43 (FIG. 8) which facilitates selective unseating and removal of the manhole cover 40 from the opening 46. The device 1 may be mounted in the device opening 41 of the manhole cover 40 such as in a manner and for purposes which will be hereinafter described.

Referring next to FIGS. 4-7 of the drawings, the device 1 includes a device housing 2. The device housing 2 may include steel, aluminum, carbon fiber composite, inert plastic or other suitable material, or any combination thereof. The device housing 2 may include a head portion 3 and an insert portion 4 which extends from the head portion 3. The insert portion 4 of the device housing 2 may be sized and configured for insertion through at least a portion of the device opening 41 in the manhole cover 40. A device bore 5 extends through the head portion 3 and the insert portion 4 of the device housing 2. In some embodiments, the device bore 5 may have a diameter or width of about ½ inch. In other embodiments, the device bore 5 may have a diameter or width which is greater or less than ½ inch.

Figure 3:
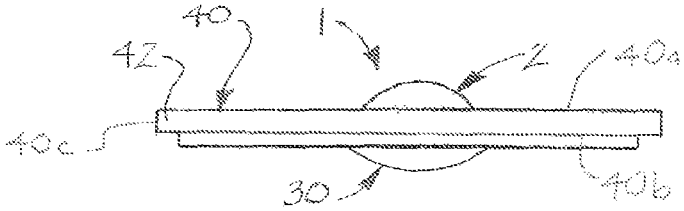
FIG. 3 is a side view of an illustrative embodiment of the manhole cover venting and precipitation guarding devices, mounted in a manhole cover.

The head portion 3 of the device housing 2 has an inner head portion surface 3*a* which may be generally flat or planar and engages the exterior manhole cover surface 40*a* of the manhole cover 40. An outer head portion surface 3*b* of the head portion 3 protrudes beyond the plane of the exterior manhole cover surface 40*a*. The head portion 3 may have a head portion apex 6 at the maximum head portion thickness 7 between the inner head portion surface 3*a* and the outer head portion surface 3*b*. T he device bore 5 may enter the outer head portion surface 3*b* at the head portion apex 6. In some embodiments, the maximum head portion thickness 7 may be about ⅝ inch. In other embodiments, the maximum head portion thickness 7 may be greater or less than about ⅝ inch. As illustrated in FIG. 3, the head portion apex 6 of the head portion 3 may represent the highest point on the entire exterior manhole cover surface 40*a*.

In some embodiments, the outer head portion surface 3*b* of the head portion 3 may be convex, as illustrated. In other embodiments, the outer head portion surface 3*b* may be truncated, round, square, octagonal or other shape.

In some embodiments, a device valve 8 may be disposed in fluid communication with the device bore 5 of the device housing 2 and may open to the interior manhole cover surface 40*b* of the manhole cover 40. The device valve 8 may be configurable between an unsealing position (FIG. 4) and a sealing position (FIG. 7) such as in a manner which will be hereinafter described. In the unsealing position, the device valve 8 may establish fluid communication between the exterior manhole cover surface 40*a* and the interior manhole cover surface 40*b*. In the sealing position, the device valve 8 may seal the exterior manhole cover surface 40*a* from the interior manhole over surface 40*b* for purposes which will be hereinafter described. The device valve 8 may have a device valve wall 9 which extends from the insert portion 4 of the device housing 2 and inserts through the remaining portion of the device opening 41. The device valve wall 9 may form a valve interior 10 which communicates with the device bore 5 in the unsealing position of the device valve 8 and may be blocked or sealed from the device bore 5 in the sealing position of the device valve 8.

Figure 4:
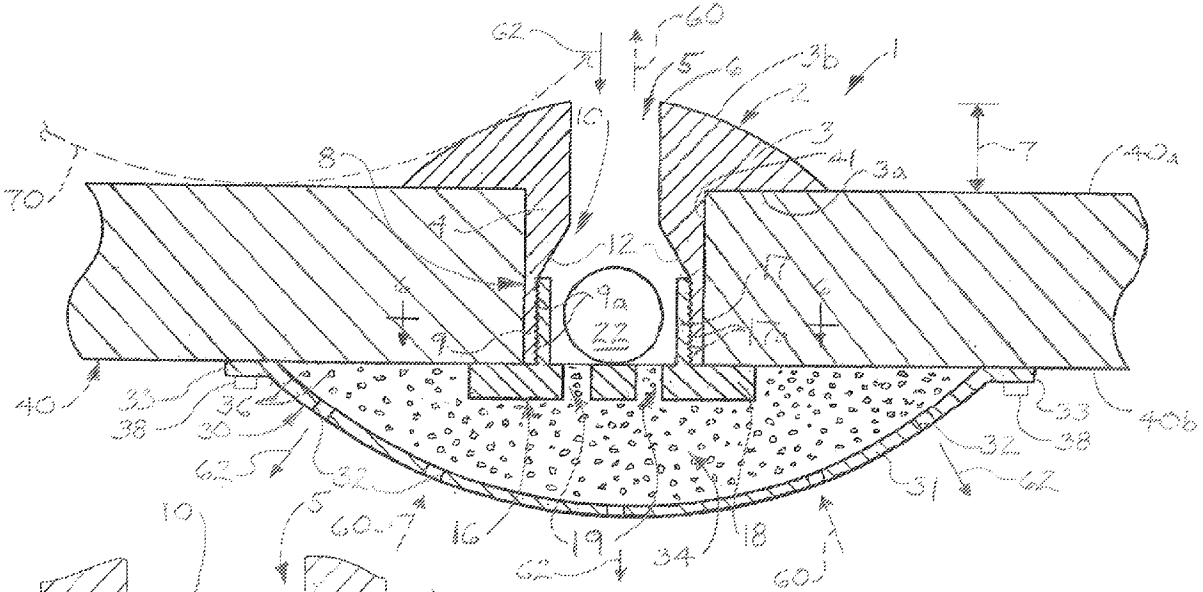
FIG. 4 is a sectional view of an illustrative embodiment of the manhole cover venting and precipitation guarding devices, with an exemplary device valve component of the device disposed in an unsealing position.
Figure 6:
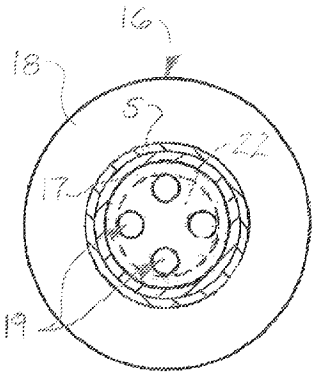
FIG. 6 is a sectional view of the exemplary device valve component, taken along section lines 6-6 in FIG. 4.
Figure 7:
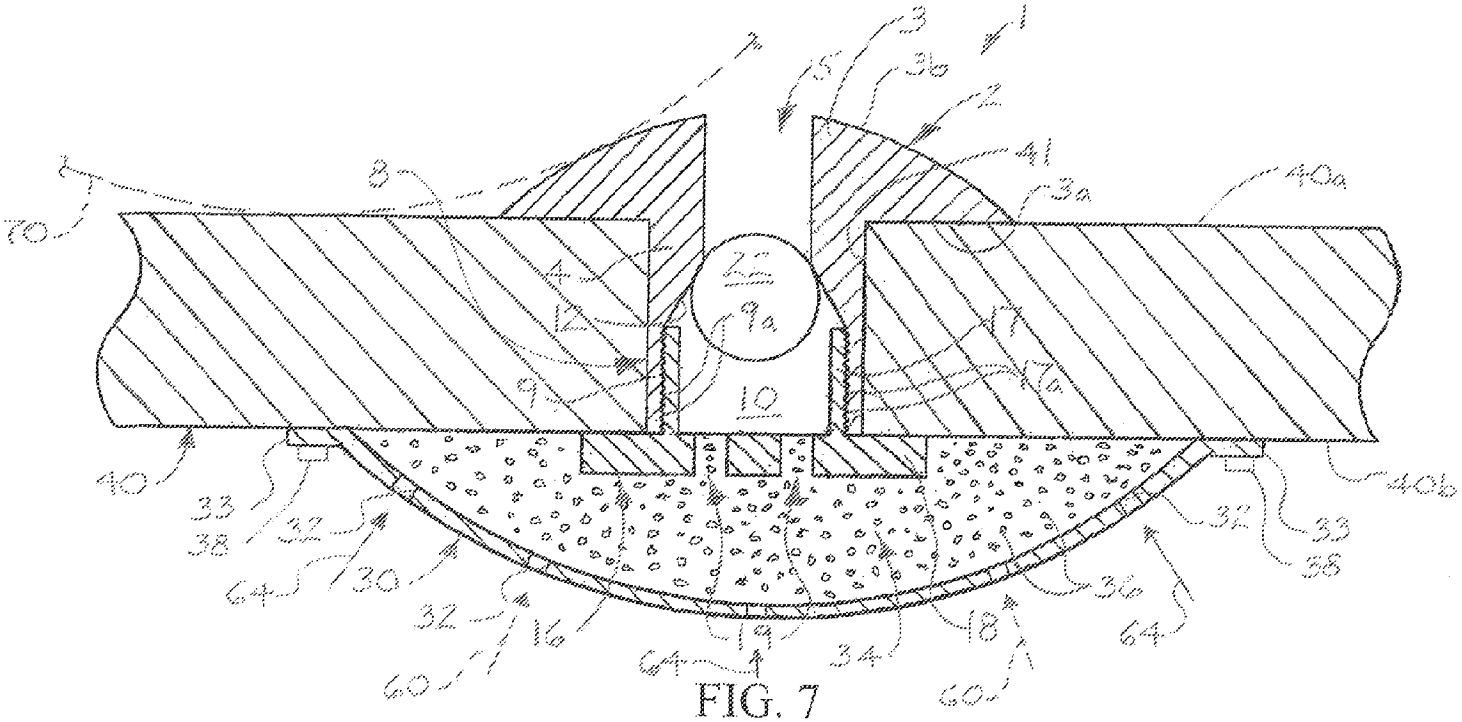
FIG. 7 is an enlarged sectional view of the exemplary device valve disposed in the sealing position.
Figure 8:
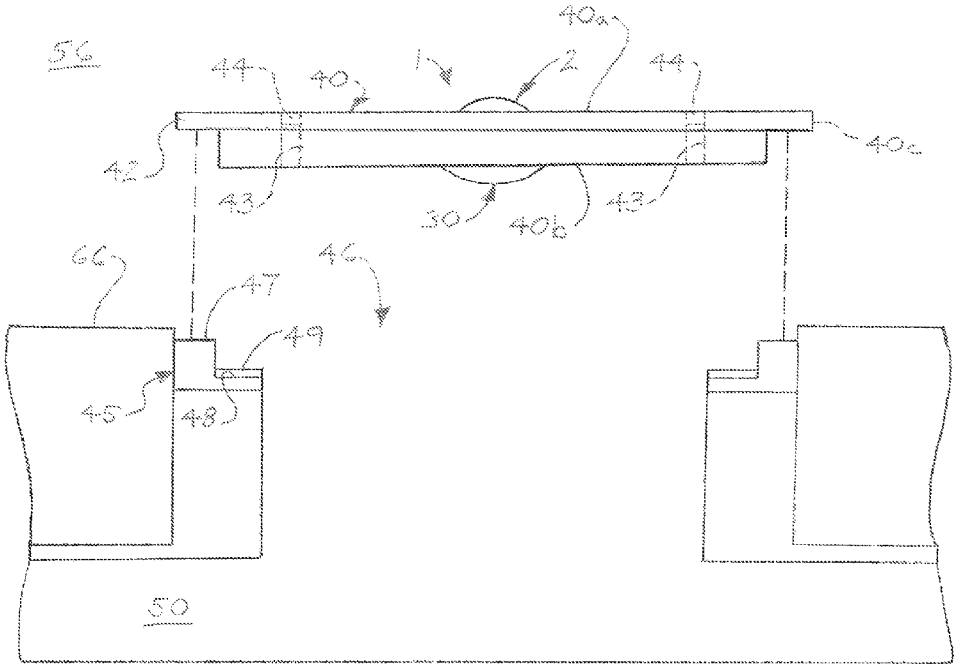
FIG. 8 is an exploded side view illustrating placement of a manhole cover fitted with an illustrative embodiment of the manhole cover venting and precipitation guarding devices in a manhole opening.

In some embodiments, the valve interior 10 of the device valve 8 may have a diameter or width which exceeds the diameter or width of the device bore 5. Accordingly, a beveled valve seat 12 may be provided between the valve interior 10 and the device bore 5. A valve ball 22 may be provided in the valve interior 10 of the device valve 8. The valve ball 22 may be a water-buoyant material such as plastic, for example and without limitation. The valve ball 22 may be positional between the unsealing position in which the valve ball 22 disengages the valve seat 12, as illustrated in FIG. 4, and the sealing position in which the valve ball 22 engages the valve seat 12 and blocks fluid communication between the device bore 5 and the valve interior 10, as illustrated in FIG. 7.

Figure 5:
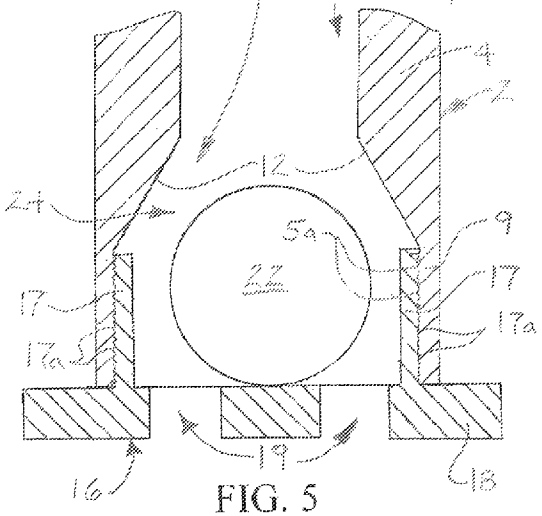
FIG. 5 is an enlarged sectional view of the exemplary device valve disposed in the unsealing position.

A device anchor 16 may engage the device valve 8 and the interior manhole cover surface 40*b* of the manhole cover 40. The device anchor 16 may include steel, aluminum, carbon fiber composite, inert plastic or other suitable material, or any combination thereof. The device anchor 16 may include a bushing having a device anchor wall 17 with exterior device anchor threads 17*a* which engage complementary interior wall threads 9*a* on the device anchor wall 9 of the device valve 8. A device anchor flange 18 may be provided on the device anchor wall 17. The device anchor flange 18 may engage the interior manhole cover 40*b* of the manhole 40. In the unsealing position of the device valve 8 (FIG. 4), the valve ball 22 may seat by gravity on the device anchor flange 18 of the device anchor 16. At least one vent opening 19 may extend through the device anchor flange 18 of the device anchor 16. In various embodiments, any number of vent openings 19 may extend through the device anchor flange 18 of the device anchor 16 in any desired pattern. As illustrated in FIG. 5, in the unsealing position of the device valve 8, the vent opening 19 is disposed in fluid communication with the valve interior 10 through a gas flow space 24 which surrounds the valve ball 22.

In some embodiments, the device 1 may include a gas absorbing device 30 which, in application of the device 1, absorbs at least a portion of the sewer gas 60 from the sewer 50 as will be hereinafter further described. The gas absorbing device 30 may include a device cover 31 which may be generally bowl-shaped or semi-spherical and has a cover interior 34 which is disposed in fluid communication with the vent openings 19 in the device anchor flange 18 of the device anchor 16. The device cover 31 may include steel, aluminum, carbon fiber composite, inert plastic or other suitable material, or any combination thereof. At least one gas opening 32 may extend through the device cover 31. the device cover 31 may be adapted for attachment to the interior manhole cover surface 40*b* of the manhole cover 40 via any suitable attachment technique which is known by those skilled in the art. For example and without limitation, in some embodiments, a cover attachment flange 33 may extend outwardly from the device cover 31. Fasteners 38 may be extended through fastener openings (not illustrated) in the cover attachment flange 33 and secured in fastener openings (not illustrated) in the manhole cover 40 to secure the device cover 31 to the manhole cover 40. In some embodiments, the device cover 31 of the gas absorbing device 30 may additionally or alternatively be attached to the device anchor 16 using any suitable attachment technique.

A gas absorbing material 36 is provided in the cover interior 34 of the device cover 31. The gas absorbing material 36 may include any type of particulate or non-particulate material which is capable of absorbing the sewer gas 60 (FIG. 11) from the sewer 50 as the sewer gas 60 flows through the cover interior 34. For example and without limitation, in some embodiments the gas absorbing material 36 may include sawdust. The gas absorbing material 36 may absorb at least a portion of the sewer gas 60 as it emanates from the sewer 50, as will be hereinafter further described.

Referring again to FIGS. 8-11 of the drawings, in exemplary application, the device 1 may be installed in a manhole cover 40 by initially forming the device opening 41 (FIG. 4) through the manhole cover 40. In some applications, the device opening 41 may be drilled or otherwise formed through the manhole cover. In other applications, the manhole cover 40 may be fabricated with the device opening 41 in place according to the knowledge of those skilled in the art. The insert portion 4 of the device housing 2 and the device valve wall 9 of the device valve 8 are inserted through the device opening 41 until the head portion surface 3*a* of the head portion 3 engages the exterior manhole cover surface 40*a* of the manhole cover 40. The valve ball 22 is placed in the valve interior 10 of the device valve 8, and the device anchor 16 is attached to the device valve wall 9 typically at the wall threads 9*a* and the device anchor threads 17*a* such that the device anchor flange 18 engages the exterior manhole cover surface 40*b* of the manhole cover 40. Plugs 44 may be inserted in any pre-existing manhole cover openings 43 in some conventional manhole covers 40. In some applications, the device housing 2 and the device anchor 16 may be fabricated in one piece with the manhole cover 40 using casting, molding, machining and/or other techniques known by those skilled in the art.

In some applications, the gas absorbing device 30 may be assembled on the device 1. Accordingly, the gas absorbing material 36 is placed in the cover interior 34 of the device cover 31. The device cover 31 may be attached to the interior manhole cover surface 40*b* via the fasteners 38 and/or to the device anchor 16 using some other suitable fastening technique.

The manhole cover 40 with the device 1 is installed in a manhole opening 46 which extends through the ground or roadway surface 66 and communicates with the subterranean sanitary sewer 50. In some applications, the manhole opening 46 may be circumscribed by a stepped outer manhole opening shoulder 47 and inner manhole opening shoulder 48. A gasket 49 may be provided on the inner manhole opening shoulder 48 for sealing purposes. The outer manhole opening shoulder 47 and the inner manhole opening shoulder 48 may be part of a manhole ring 45 which may include steel, iron or other metal. The manhole cover 40 with the device 1 is placed in the manhole opening 46 with the outer portion of the interior manhole cover surface 40*b* resting on the gasket 49 and the manhole cover flange 42 resting on the outer manhole opening shoulder 47. In some applications, the manhole cover 40 may be bolted and/or otherwise fixedly secured over the manhole opening 46 according to the knowledge of those skilled in the art.

Figure 9:
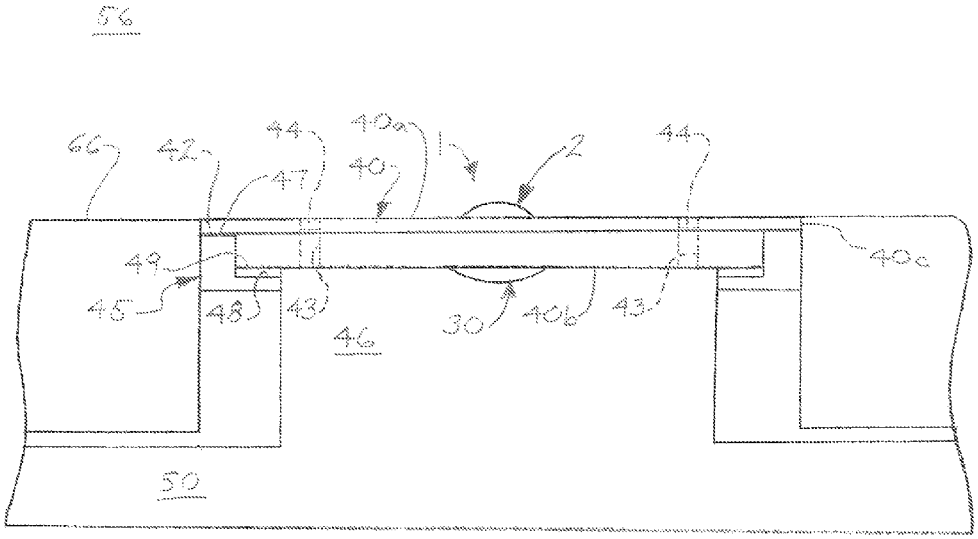
FIG. 9 is a side view of the manhole cover fitted with an illustrative embodiment of the manhole cover venting and precipitation guarding devices in the manhole opening.
Figure 10:
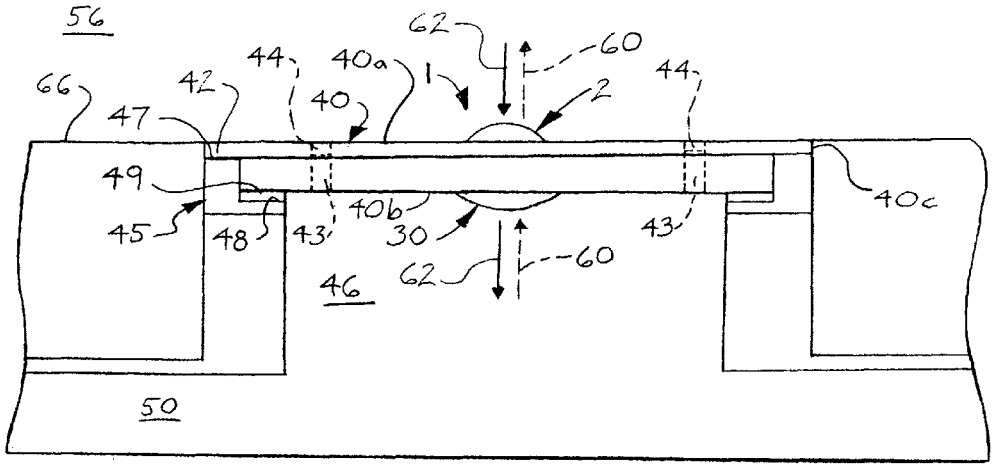
FIG. 10 is a side view of the manhole cover fitted with an illustrative embodiment of the manhole cover venting and precipitation guarding devices in the manhole opening, more particularly illustrating discharge of sewer gas from the manhole opening through the device to the atmosphere and flow of precipitation from the atmosphere through the device into the manhole opening.
Figure 11:
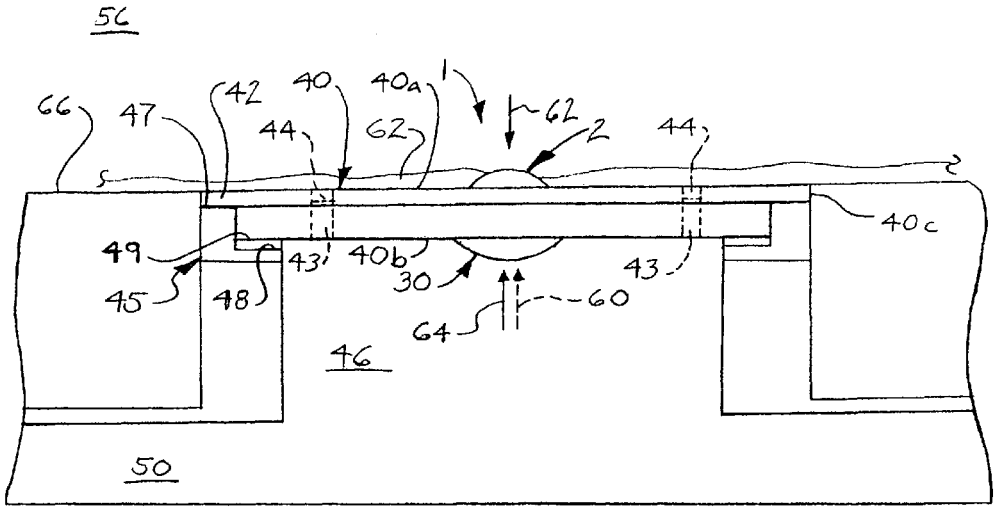
FIG. 11 is a side view of the manhole cover fitted with an illustrative manhole cover venting and precipitation guarding devices in the manhole opening, more particularly illustrating blockage of sewer gas from the manhole opening through the device to the atmosphere, blockage of precipitation from the atmosphere through the device into the manhole opening and blockage of overflow water from the manhole opening through the device.

As illustrated in FIGS. 9-11, the exterior manhole housing cover surface 40*a* of the manhole cover 40 may be generally flush with the ground or roadway surface 66. As illustrated in FIGS. 4 and 7, in some embodiments, the protruding convex outer head portion surface 3*b* on the head portion 3 of the device housing 2 enables an automobile wheel 70 of an automobile (not illustrated) to easily traverse the device 1 as the automobile wheel 70 traverses the ground or roadway surface 66.

As illustrated in FIGS. 4 and 10, in some applications, such as those in which the manhole cover 40 is bolted and/or otherwise attached to the manhole ring 45, the valve ball 22 of the device valve 8 is normally disposed in the unsealing position illustrated in FIG. 4. Accordingly, sewer gas 60 may rise from the sewer 50 and flow through the gas openings 32 in the device cover 31. The gas absorbing material 36 in the gas absorbing device 30 may absorb a substantial portion of the sewer gas 60. Any remaining unabsorbed portion of the sewer gas 60 may rise from the gas absorbing device 30 through the vent opening or openings 19 in the device anchor 16 and the gas flow space 24 (FIG. 5), respectively, to the valve interior 10 of the device valve 8. The sewer gas 60 may exit the device housing 2 to the atmosphere 56 through the device bore 5. Because the gas absorbing material 36 in the gas absorbing device 30 may absorb a substantial quantity of the sewer gas 60 from the sewer 50, the otherwise objectionable smell of the sewer gas 60 in the atmosphere 56 may be eliminated or at least substantially reduced.

As further illustrated in FIGS. 4 and 10, during rainfall or other precipitation 62, as during no precipitation, the valve ball 22 of the device valve 8 may normally be disposed in the unsealing position and seat by gravity on the device anchor flange 18 of the device anchor 16 to facilitate venting of sewer gas 60 from the sewer 50 to the atmosphere 56, as was heretofore described. A small portion of the falling precipitation 62, the quantity of which is substantially limited by the diameter or width of the device bore 5, may be capable of entering the sewer 50 through the device bore 5, the valve interior 10, the gas flow space 24, the gas absorbing device 30 and the manhole opening 46, respectively. In the event that the precipitation 62 accumulates or pools on the ground or roadway surface 66, the height of the head portion apex 6 of the head portion surface 3*a* on the head portion 3 of the device housing 2 beyond the plane of the ground or roadway surface 66 further limits the quantity of precipitation 62 which can enter the sewer 50 by preventing the pooled precipitation 62 from flowing into the device bore 5 until the depth of the pooled precipitation 62 exceeds the height of the head portion apex 6.

As illustrated in FIGS. 7 and 11, under some conditions, overflow water 64 may rise in the sewer 50. The manhole cover 40 may have been bolted to the underlying manhole ring 45, and the gasket 49 imparts a fluid-tight seal between the manhole cover 40 and the manhole ring 45. The overflow water 64 may rise through the gas absorbing device 30, the vent opening 19 in the device anchor 16 and the valve interior 10 of the device valve 8, respectively. The rising overflow water 64 floats the valve ball 22 in the valve interior 10, ultimately causing the valve ball 22 to seat against the valve seat 12. Accordingly, the valve ball 22 seals the valve interior 10 from the device bore 5 of the device housing 2 and prevents the overflow water 64 and raw sewage in the overflow water 64 from discharging through the device bore 5 to the ground or roadway surface 66.

It will be appreciated by those skilled in the art that the device 1 prevents a substantial portion of falling or pooled precipitation 62 from entering the sewer 50 through the manhole opening 46. The device 1 facilitates escape of sewer gas 60 from the sewer 50 to the atmosphere 56 even during rainfall or other falling precipitation 62. The device 1 can be fitted with the gas absorbing device 30 without compromising the gas venting and precipitation or overflow prevention capabilities of the device 1. The device valve 8 of the device prevents overflow water 64 from discharging to the ground or roadway surface 66, particularly in applications in which the manhole cover 40 is bolted and/or otherwise secured in the manhole opening 46. The device 1 may prevent application of a vacuum seal to the manhole cover 40, rendering ease in removal of the manhole cover 40 from the manhole opening 46. The device 1 may prevent rusting of the manhole cover to the underlying manhole ring 45, also rendering ease in removal of the manhole cover 40 from the manhole opening 46. The device 1 may additionally prevent or reduce rattling of the manhole cover 40 as the automobile wheel 70 (FIGS. 4 and 7) traverses the manhole cover 40 and the device 1.

It will be further appreciated by those skilled in the art that the gas absorbing material 36 in the cover interior 34 of the device cover 31 of the gas absorbing device 30 may be periodically replaced, as deemed necessary, by removing the manhole cover 40 from the manhole opening 46; removing the device cover 31 from the manhole cover 40 and/or the device anchor 16; removing the used gas absorbing material 36 from the cover interior 34; placing fresh or replacement gas absorbing material 36 in the cover interior 34; reattaching the manhole cover 40 to the manhole cover 40 and/or device anchor 16; and replacing the manhole cover 40 in the manhole opening 46, respectively.

Figure 12:
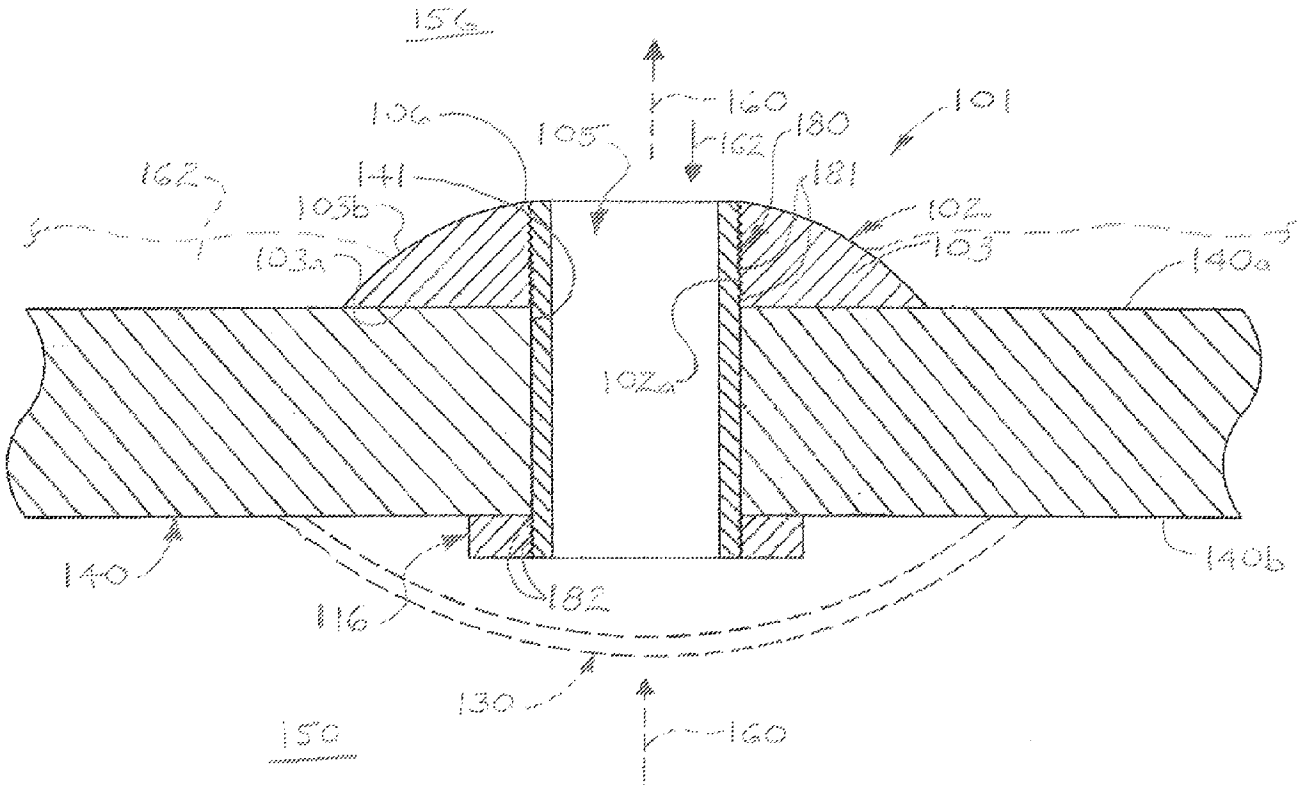
FIG. 12 is a sectional view of an alternative illustrative embodiment of the manhole cover venting and precipitation guarding devices.

Referring next to FIG. 12 of the drawings, an alternative illustrative embodiment of the manhole cover venting and precipitation guarding device, hereinafter device, is generally indicated by reference numeral 101. In the device 101, elements which are analogous to the respective elements of the device 1 that was heretofore described with respect to FIGS. 1-11 are designated by the same numeral in the 100 series in FIG. 12. The device bore 105 may extend completely through the device 101 from the exterior manhole cover surface 140*a* to the interior manhole cover surface 140*b* of the manhole cover 140. A device nipple 180 having exterior upper nipple threads 181 and exterior lover nipple threads 182 may extend through the device opening 141 of the manhole cover 140. The device housing 102 may have a device housing opening 102*a* through which the device nipple 180 extends. The device housing 102 may threadably engage the upper nipple threads 181 on the device nipple 180 at the exterior manhole cover surface 140*a*. A device anchor 116 may include a nut which threadably engages the lower nipple threads 182 at the interior manhole over surface 140*b* of the manhole cover 140. The device bore 105 may extend substantially through the entire device nipple 180. In some embodiments, the device valve 8 and the valve seat 12 (FIGS. 4 and 7) may be omitted from the device housing bore 105 of the device 101. Accordingly, the device bore 105 of the device 101 may be mechanically and structurally unimpeded throughout its length from the head portion apex 106 on the outer head portion surface 103*b* of the head portion 103 through the device anchor 116. In some embodiments, the device housing 102 and the device nipple 180, and/or the device nipple 180 and the device anchor 116, may be fabricated in one piece via casting, molding,. machining and/or other suitable techniques known by those skilled in the art. In some embodiments, the device housing 102, the device nipple 180 and the device anchor 116 may be fabricated in one piece with the manhole cover 140 according to the knowledge of those skilled in the art.

In some embodiments, a gas absorbing device 130 (illustrated in phantom) may be attached to the exterior manhole cover surface 140*b* of the manhole cover 140 and/or to the device anchor 116 according to the knowledge of those skilled in the art. The gas absorbing device 130 may have a design which is the same as or similar to that of the gas absorbing device 30 which was heretofore described with respect to the device 1 in FIGS. 1-11.

Exemplary application of the device 101 may be as was heretofore described with respect to the device 1 in FIGS. 1-11. Accordingly, the device bore 105 may facilitate substantially unimpeded flow and discharge of sewer gas 160 from the sewer 150 to the atmosphere 156 through the manhole opening 146 and the manhole cover 140. Before it is discharged through the device bore 105 to the atmosphere 156, a substantial portion of the sewer gas 160 may be absorbed by the gas absorbing device 130 such as in the manner which was heretofore described. The relatively small diameter of the device bore 105 (½ inch in some embodiments) may substantially limit the quantity of precipitation 162 which is capable of entering the sewer 150 through the device bore 105. Additionally, the raised profile of the head portion apex 106 on the outer head portion surface 103*b* at the device bore 105 substantially limits the quantity or pooled precipitation 162 which can flow from the exterior manhole cover surface 140*a* of the manhole cover 140 through the device bore 105 and into the sewer 150.

Figure 13:
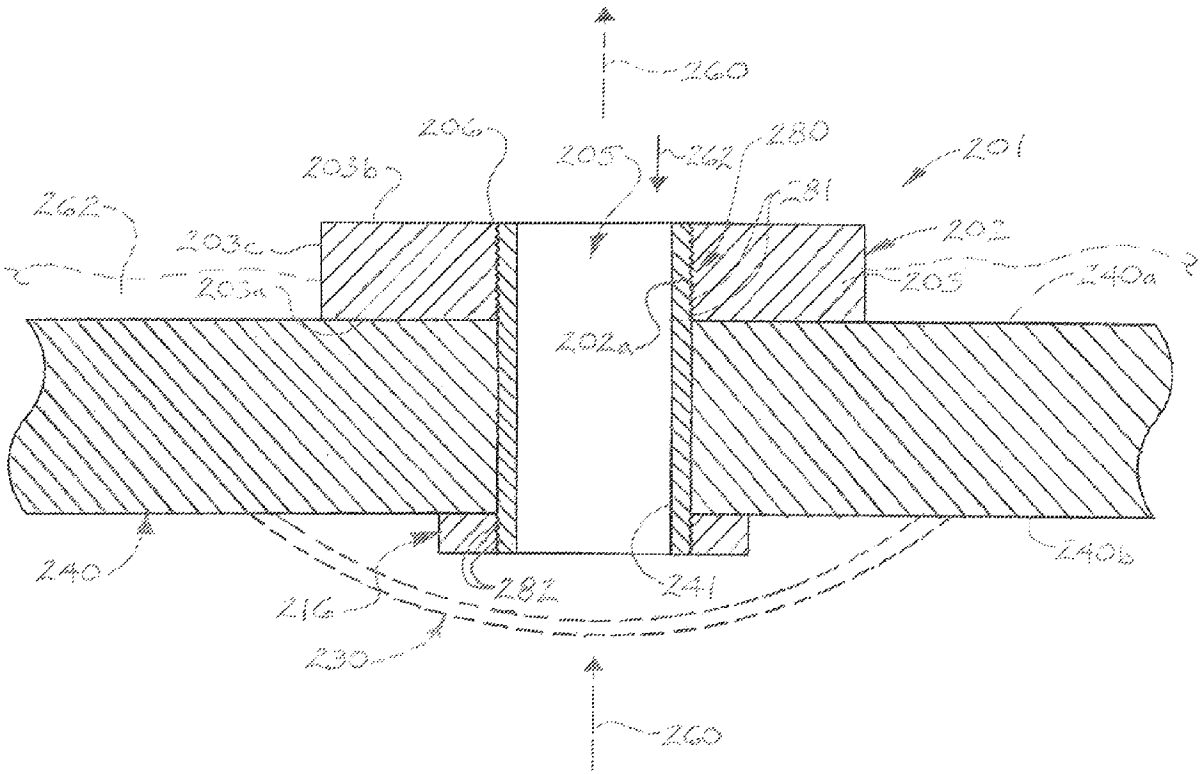
FIG. 13 is a sectional view of another alternative illustrative embodiment of the manhole cover venting and precipitation guarding devices.

Referring next to FIG. 13 of the drawings, another alternative illustrative embodiment of the manhole cover venting and precipitation guarding device, hereinafter device, is generally indicated by reference numeral 201. In the device 201, elements which are analogous to the respective elements of the device 101 that was heretofore described with respect to FIG. 12 are designated by the same numeral in the 200 series in FIG. 13. The head portion 203 of the device housing 202 may have a generally cylindrical shape with an inner head portion surface 203*a* which engages the exterior manhole cover surface 240*a*, an outer head portion surface 240*b* which is parallel to the inner head portion surface 203*a* and an annular side head portion surface 203*c* which extends between the inner head portion surface 203*a* and the outer head portion surface 203*b*. Application of the device 201 may be as was heretofore described with respect to the device 101 in FIG. 12.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A manhole cover venting and precipitation guarding device for a manhole cover having an exterior manhole cover surface and an interior manhole cover surface, the manhole cover venting and precipitation guarding device comprising:

a device housing adapted for attachment to the manhole cover, the device housing including:

a head portion having a head portion surface adapted to protrude beyond an entire plane of the exterior manhole cover surface;

a device bore extending through the head portion and adapted to communicate with the interior manhole cover surface of the manhole cover;

a device valve disposed in fluid communication with the device bore of the head portion, the device valve adapted for opening to the interior manhole cover surface and adapted to seal the exterior manhole cover surface from the interior manhole cover surface in a sealing position and establish fluid communication between the exterior manhole cover surface and the interior manhole cover surface in an unsealing position; and the device valve including a valve interior communicating with the device bore of the device housing, a valve seat between the valve interior and the device bore and a valve ball in the valve interior, the valve ball positional between engaging the valve seat in the sealing position and disengaging the valve seat in the unsealing position.

2. The manhole cover venting and precipitation guarding device of claim 1 further comprising a device anchor carried by the device housing, the device anchor adapted to engage the interior manhole cover surface.

3. The manhole cover venting and precipitation guarding device of claim 2 wherein the device anchor comprises a device anchor wall carried by the device valve and a device anchor flange carried by the device anchor wall, the device anchor flange adapted to engage the interior manhole cover surface.

4. The manhole cover venting and precipitation guarding device of claim 3 further comprising at least one vent opening in the device anchor flange of the device anchor and disposed in fluid communication with the device valve.

5. The manhole cover venting and precipitation guarding device of claim 1 further comprising a device anchor carried by the device valve, the device anchor comprising a device anchor wall carried by the device valve and a device anchor flange carried by the device anchor wall, the device anchor flange adapted to engage the interior manhole cover surface; and at least one vent opening in the device anchor flange of the device anchor and disposed in fluid communication with the valve interior of the device valve, the valve ball normally seats against the device anchor flange of the device anchor by gravity in the unsealing position.

6. The manhole cover venting and precipitation guarding device of claim 1 wherein the head portion surface of the head portion is convex.

7. A manhole cover venting and precipitation guarding device for a manhole cover having an exterior manhole cover surface and an interior manhole cover surface, the manhole cover venting and precipitation guarding device comprising:

a device housing adapted for attachment to the manhole cover, the device housing including:

a head portion having an inner head portion surface adapted to engage the exterior manhole cover surface, an outer head portion surface adapted to protrude beyond an entire plane of the exterior manhole cover surface and a head portion apex on the outer head portion surface;

a device bore extending though the head portion of the device housing, the device bore adapted to establish fluid communication between the head portion apex of the head portion surface on the head portion and the interior manhole cover surface of the manhole cover;

a device valve disposed in fluid communication with the device bore, the device valve adapted for opening to the interior manhole cover surface and adapted to seal the exterior manhole cover surface from the interior manhole cover surface in a sealing position and establish fluid communication between the exterior manhole cover surface and the interior manhole cover surface in an unsealing position; and the device valve including a valve interior communicating with the device bore of the device housing, a valve seat between the valve interior and the device bore and a valve ball in the valve interior, the valve ball positional between engaging the valve seat in the sealing position and disengaging the valve seat in the unsealing position.

8. The manhole cover venting and rain guarding device of claim 7 further comprising a device anchor carried by the device housing, the device anchor adapted to engage the interior manhole cover surface.

9. The manhole cover venting and precipitation guarding device of claim 8 wherein the device anchor comprises a device anchor wall carried by the device valve and a device anchor flange carried by the device anchor wall, the device anchor flange adapted to engage the interior manhole cover surface.

10. The manhole cover venting and precipitation guarding device of claim 9 further comprising at least one vent opening in the device anchor flange of the device anchor and disposed in fluid communication with the device valve.

11. The manhole cover venting and precipitation guarding device of claim 7 further comprising a device anchor carried by the device valve, the device anchor comprising a device anchor wall carried by the device valve and a device anchor flange carried by the device anchor wall, the device anchor flange adapted to engage the interior manhole cover surface; and at least one vent opening in the device anchor flange of the device anchor and disposed in fluid communication with the valve interior of the device valve, the valve ball normally seats against the device anchor flange of the device anchor by gravity in the unsealing position.

12. The manhole cover venting and precipitation guarding device of claim 7 wherein the head portion surface of the head portion is convex.

13. A manhole cover venting and precipitation guarding device for a manhole cover having an exterior manhole cover surface and an interior manhole cover surface, the manhole cover venting and precipitation guarding device comprising:

a device housing adapted for attachment to the manhole cover, the device housing including:

a head portion having an inner head portion surface adapted to engage the exterior manhole cover surface, an outer head portion surface adapted to protrude beyond an entire plane of the exterior manhole cover surface and a head portion apex on the outer head portion surface; and a device housing opening extending through the head portion of the device housing from the head portion apex of the outer head portion surface to the inner head portion surface;

a device nipple extending through the device housing opening of the device housing;

a device anchor canted by the device nipple and adapted to engage the interior manhole cover surface of the manhole cover; and a device bore extending through the device nipple, the device bore adapted to establish fluid communication between the head portion apex of the head portion surface on the head portion of the device housing and the interior manhole cover surface of the manhole cover; and a gas absorbing device including:

a device cover having a cover interior normally disposed in communication with the device bore; and a gas absorbing material in the cover interior of the device cover.

14. The manhole cover venting and precipitation guarding device of claim 13 wherein the head portion surface of the head portion is convex.

15. The manhole cover venting and precipitation guarding device of claim 13 wherein the head portion is generally cylindrical.

16. The manhole cover venting and precipitation guarding device of claim 13 wherein the device anchor comprises a nut.

* * * * *